US011788220B2

(12) United States Patent
Weigert et al.

(10) Patent No.: US 11,788,220 B2
(45) Date of Patent: Oct. 17, 2023

(54) APPARATUS FOR COMPACTING AND/OR STRUCTURING A NONWOVEN, AND A STRUCTURAL SHELL

(71) Applicant: TRÜTZSCHLER GMBH & CO. KG, Mönchengladbach (DE)

(72) Inventors: Thomas Weigert, Sulzbach (DE); Peter Körner, Langen (DE); Florian Seils, Seligenstadt (DE); Rolf Schröder, Langen (DE); Bernd Stork, Riedstadt (DE)

(73) Assignee: TRÜTZSCHLER GMBH & CO. KG, Monchengladbach (DE)

( * ) Notice: Subject to any disclaimer, the term of this patent is extended or adjusted under 35 U.S.C. 154(b) by 2 days.

(21) Appl. No.: 17/262,116

(22) PCT Filed: Jul. 19, 2019

(86) PCT No.: PCT/EP2019/069517
§ 371 (c)(1),
(2) Date: Jan. 21, 2021

(87) PCT Pub. No.: WO2020/035257
PCT Pub. Date: Feb. 20, 2020

(65) Prior Publication Data

US 2021/0292946 A1 Sep. 23, 2021

(30) Foreign Application Priority Data

Aug. 13, 2018 (DE) ..... 10 2018 119 570.2

(51) Int. Cl.
*D04H 1/495* (2012.01)
*D04H 18/04* (2012.01)

(52) U.S. Cl.
CPC ..... *D04H 1/495* (2013.01); *D04H 18/04* (2013.01)

(58) Field of Classification Search
CPC ..... D04H 18/04; D04H 1/465; D04H 1/492; D04H 1/495; D04H 3/11; D04H 5/03;
(Continued)

(56) References Cited

U.S. PATENT DOCUMENTS 2,701,957 A 2/1955 Newcomb et al.
3,590,453 A * 7/1971 Bryand ..... D21F 3/105 428/116

(Continued)

FOREIGN PATENT DOCUMENTS

CN 104289445 A * 1/2015
DE 10001535 A1 7/2001

(Continued)

OTHER PUBLICATIONS

German Search Report in related German Patent Application No. 102018119570.2, 19 pages with English Google Translation.

(Continued)

*Primary Examiner* — Amy Vanatta
(74) *Attorney, Agent, or Firm* — FisherBroyles, LLP; Robert Kinberg

(57) ABSTRACT

The invention relates to a device for hydroentangling and/or structuring webs that includes an suctioning rotating drum and a structured shell, including at least two rings which can be pushed on and attached to the drum, is disposed at a distance from the cylindrical surface of the drum around. A web can be at least partially looped around the structured shell. At least one water bar including a nozzle strip with a plurality of nozzles is arranged relative to the structured shell to entangle and/or to structure and/or to perforate the web by the water jets. The invention further relates to the structured shell.

19 Claims, 5 Drawing Sheets

(58) Field of Classification Search
CPC .... D04H 18/00; D06B 15/043; D06B 23/025; D06B 23/026; D21F 1/48; D21F 1/50; D21F 1/52; D21F 1/523; D21F 3/10; D21F 3/105; B65G 39/04; B65H 2404/113; B65H 2404/132; B65H 2404/1321; B65H 2404/13211; Y10T 29/49554; B01D 39/10; B41P 2231/10; A01B 29/04
USPC ..... 28/104; 492/38, 39
See application file for complete search history.

(56) References Cited

U.S. PATENT DOCUMENTS 3,668,752 A * 6/1972 Clifton ..... B32B 25/10 492/8
3,781,957 A * 1/1974 Luthi ..... D21F 5/02 492/32
4,868,958 A * 9/1989 Suzuki ..... D04H 18/04 28/104
5,038,440 A * 8/1991 Demuth ..... D01G 9/06 19/114
5,353,485 A * 10/1994 Billgren ..... D04H 1/44 28/104
5,414,914 A * 5/1995 Suzuki ..... D04H 18/04 492/30
6,782,589 B2 * 8/2004 Ngai ..... B32B 5/26 28/104
2004/0220032 A1 * 11/2004 Nakayama ..... C03B 35/181 65/374.13
2008/0066275 A1 * 3/2008 Munstermann ..... F16D 1/076 28/104
2015/0191858 A1 * 7/2015 Munstermann ..... D06C 29/00 28/104
2015/0321459 A1 * 11/2015 Frisch ..... B32B 37/0046 156/497
2016/0130092 A1 * 5/2016 Rudolph ..... B65G 39/07 198/842
2017/0114486 A1 * 4/2017 Muenstermann ..... F26B 25/20

FOREIGN PATENT DOCUMENTS

DE 102012110741 A1 5/2014
EP 0223614 A2 5/1987
EP 0315961 A2 5/1989
EP 0678613 A2 10/1995
EP 1036871 A1 9/2000
EP 1820892 A1 8/2007
EP 3159446 A2 4/2017
EP 2888394 B1 6/2018
WO 2006087064 A1 8/2006
WO 2014029451 A1 2/2014
WO 2014072001 A1 5/2014

OTHER PUBLICATIONS

International Search Report in related International Patent Application No. PCT/EP2019/069517, dated Oct. 24, 2019, 6 pages.

* cited by examiner

APPARATUS FOR COMPACTING AND/OR STRUCTURING A NONWOVEN, AND A STRUCTURAL SHELL

CROSS-REFERENCE TO RELATED APPLICATIONS

This application is a United States National Stage Application of International Application No. PCT/EP2019/069517 filed Jul. 19, 2019, claiming priority from German Patent Application No. 10 2018 119 570.2 filed Aug. 13, 2018.

BACKGROUND OF THE INVENTION

The present invention relates to a device for entangling and/or structuring a web, as well as to a structuring shell.

When hydroentangling webs, wovens or knitted fabrics, a liquid, such as water, is sprayed from a plurality of nozzles against the material to be entangled. The material to be entangled runs over a rotating liquid-permeable drum, which can be additionally charged with negative pressure for suctioning the water. Usually, the drum is a cylindrical massive base drum with bores, which guarantee large water drainage. At a distance to the base drum, a structured shell is mounted, which can have fine-porous openings for entangling the fibres. However, the structured shell can also impart a surface structure, like a pattern and/or a perforation of different geometries to the material to be treated.

According to EP 2 888 394 B1, an integral structured shell is mounted on a drum, in which wires are mounted transversely to the longitudinal axis of the drum and establish the distance between structured shell and drum. When exchanging the structured shell, the same must be pushed off of the drum, what makes for a very difficult handling at a working width of 2.5 to 5.5 meters and can potentially damage the same.

Furthermore, it is known to divide the structured shell a-long the longitudinal axis of the drum, namely, to connect several segments to each other on the circumference. This type of shell reaches its limit, when the joint of the segments must not be found in the web. Another disadvantage is the attachment of the segments among each other, as the segments consist of thin sheet metal and each change over the cross-section results in a different application on the structured shell or in unwanted impressions in the web.

Therefore, an object of the invention is to provide a device for entangling and/or structuring a web, without the aforementioned disadvantages. Furthermore, another object of the invention is to provide an improved structured shell with a considerably enlarged structuring height for the device for entangling and/or structuring a web.

SUMMARY

The invention relates to a device for hydroentangling and/or structuring a web, comprising a suctioned rotating drum, a structured shell disposed at a distance on the drum, around which a web can loop at least partially, as well as at least one water bar, which includes a nozzle strip with a plurality of nozzles, wherein the water bar is formed to entangle and/or to structure and/or to perforate the web by the water jets.

The core idea of the invention is a structured shell, which is formed from at least two rings, which can be pushed on and attached to the drum.

The structured shell is formed from at least two axially segmented rings, which are pushed over the drum at a distance from the cylindrical surface of the drum. The rings can be manufactured from different materials (plastic material, metal), e.g. by laser sintering. This method allows for more complex and higher geometries than the existing etching methods.

Of course, also conceivable are rings which are produced by other manufacturing methods, such as machined, cast or laser etched.

Axially segmenting the rings offers the possibility of employing manufacturing methods, respectively machines, which otherwise would not be suitable for the required working width, which can amount to up to 5.5 m.

According to the invention, the rings can be joined permanently to form a shell, e.g. by bonding or a mechanical connection, such as a complementary dovetail groove or tongue and groove assembly at the front faces. The individual rings can be assembled and joined to form a sealed structured shell by means of a common surface coating (e.g. nickel-plated), in order to close the parting lines between rings. The connection of the rings can be realized directly or indirectly to each other by material, positively or non-positively.

As an alternative, the rings can remain individualized and e.g. be clamped axially or radially on the support drum. Furthermore, mounting rings can be used for the butt joints of the rings, which the rings cover at least partially, and by means of which the rings are connected indirectly to each other by bonding or mechanical connection, for example clips incorporated at the mounting rings.

The rings may be produced using a 3D printer, wherein the structuring of the surface is producible in a single manufacturing step. Structuring can go beyond the cut edge to the next ring such that a structured shell is producible without a parting line.

BRIEF DESCRIPTION OF THE DRAWINGS

The invention is described in greater detail below in conjunction with the accompanying drawings in which a preferred exemplary embodiment of the invention is disclosed and other features and benefits will become apparent.

DETAILED DESCRIPTION

Figure 1:
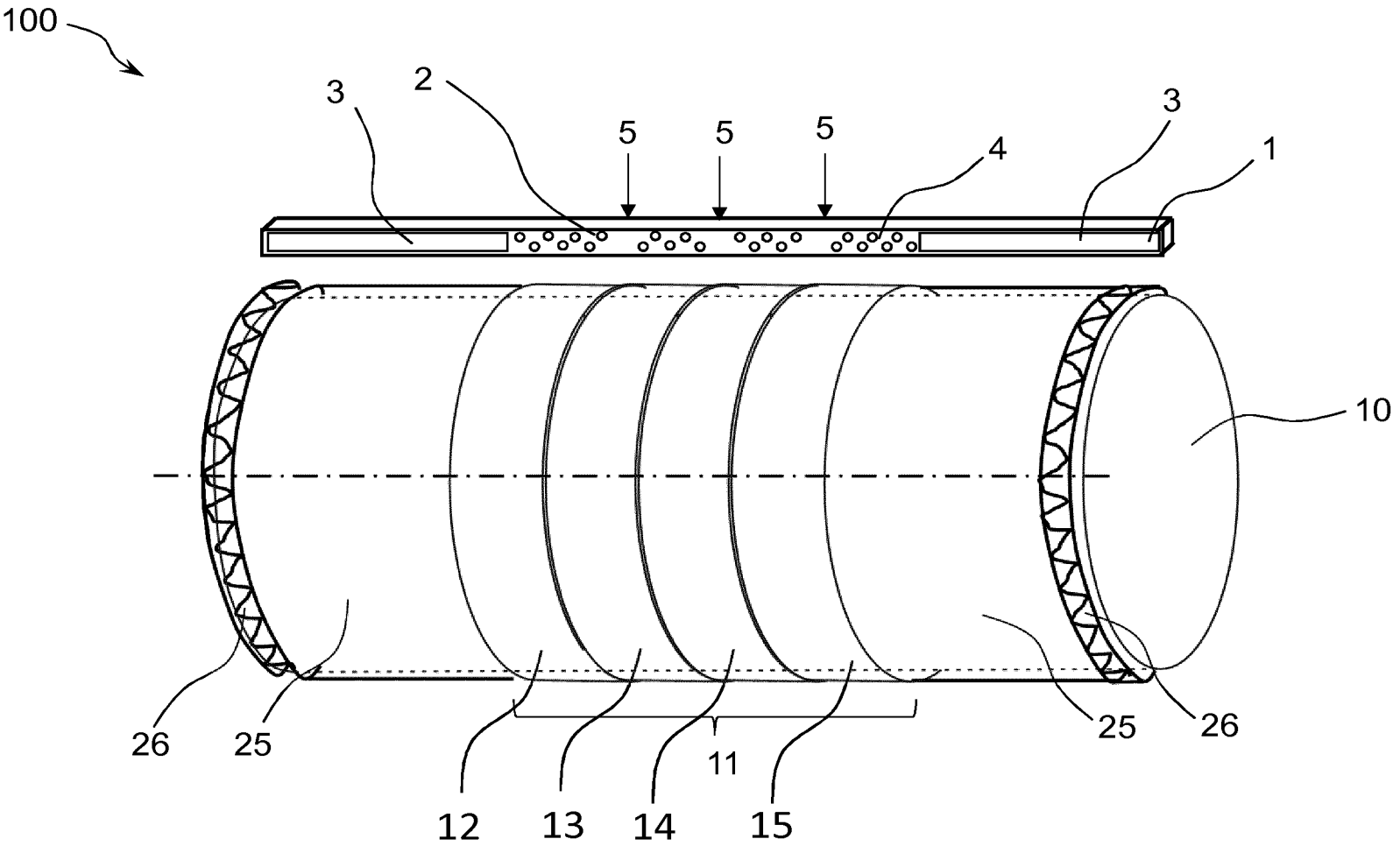
FIG. 1 shows a perspective view of a part of an installation for entangling a web.

FIG. 1 shows a device 100 for hydroentangling webs, comprising an rotating drum 10 which is suctioned from the inside, a structured shell 11 disposed at a distance from a cylindrical surface of the drum 10, as well as at least one water bar 1, which includes a nozzle strip 2 with a plurality of nozzles 4. In this illustration, the water bar 1 is rotated by 90° about its longitudinal axis for a better illustration. A non-illustrated web loops at least partially around the structured shell 11 and the water jets of the water bar 1 entangle and structure the web when in place over the drum.

The structured shell 11 is made from several pieces and, in this example, consists of four individual rings 12, 13, 14, 15, which are pushed on to the drum 10. The distance of the structured shell 11 to the drum 10 can be established with spacers and/or an additional strainer shell. In this exemplary embodiment, the drum 10 has a wider width in the axial direction than the structured shell 11, which only covers a portion of the drum 10. For centring the structured shell in the middle, lateral distancing elements 25 are pushed on to the drum 10, which are attached to the front faces of the drum 10 by clamping elements 26. The clamping elements 26 with the lateral distancing elements 25 allow for a variable width of the structured shell 11, which can consist of at least two rings, or of many rings, which together cover the entire drum 10. Thereby, the installation can be adapted to the width of the continuous web of material to be treated to minimize energy use. Alternative attachments for the rings are possible within the scope of the invention, for example a bracing of the rings between drum and ring by spring-loaded clamping elements or other mechanical fastener that will be apparent to those skilled in the art.

The water bar 1 illustrated in FIG. 1 is turned by 90° for better illustration. During operation, the nozzles 4 are oriented toward the cylindrical surface of the drum 10, aligned essentially in the direction of the longitudinal axis of the drum. The water bar 1, from which the water jets are sprayed at high pressure on to the web, includes a nozzle strip 2 with a plurality of individual nozzles 4 extending to the current working width, and is shortened laterally or is laterally covered by coverings 3. In the area of the butt joints of the rings 12, 13, 14, 15, the nozzle strip 2 has interruptions 5, such that the web to be produced has no imprinted strips. Thereby, it is possible to produce an integral web, which is further processed variably strip-shaped, for example by a separating device, wherein the strips of the web can have a different strength, structure and/or perforation. The products can be used, for example, as liners for diapers, as a cosmetic or a hygienic product.

Figure 2:
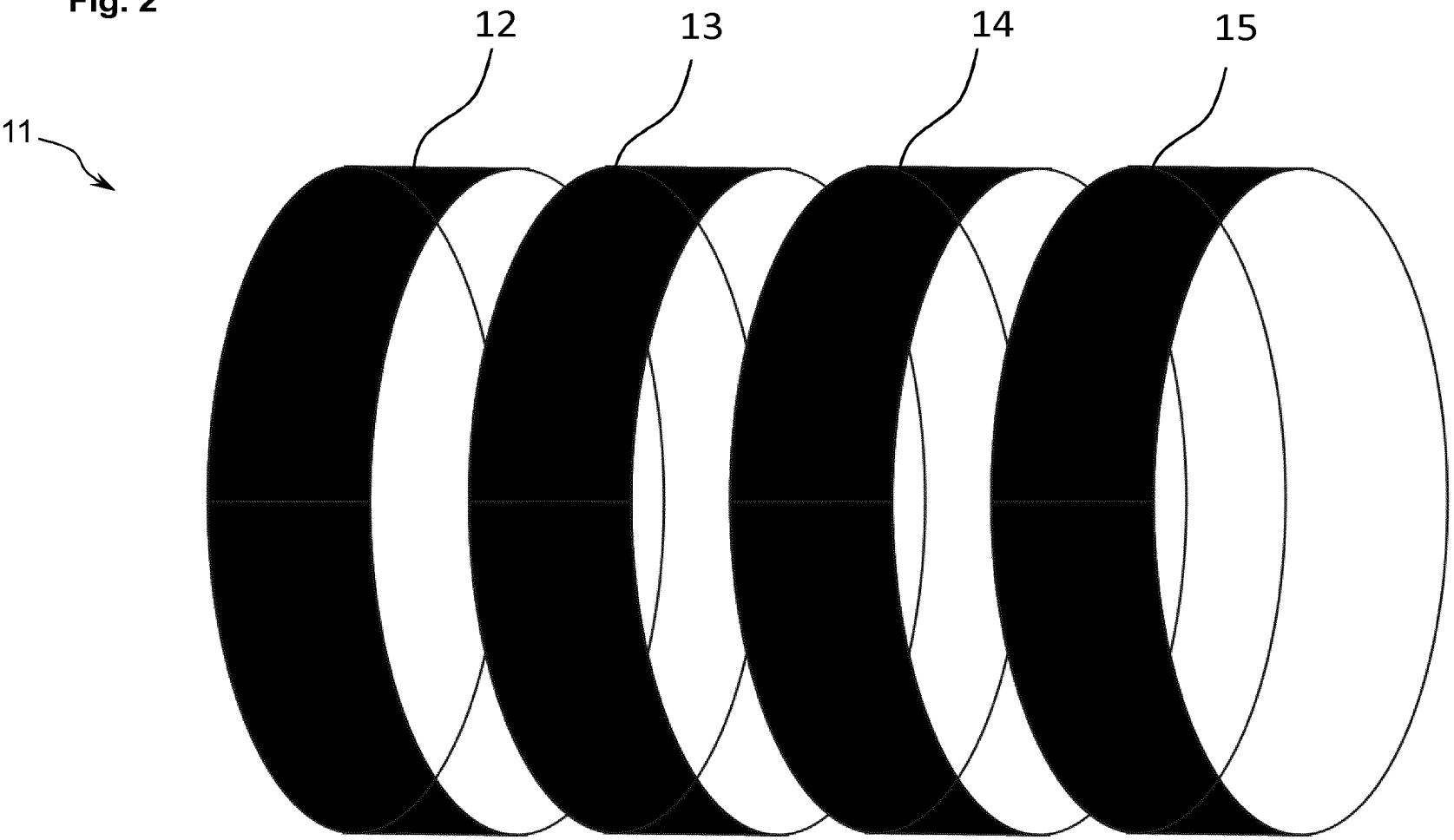
FIG. 2 show a perspective view of a structured shell made from several rings according to an embodiment of the invention.

FIG. 2 shows four rings 12, 13, 14, 15 of a structured shell 11, which are disposed at an axial distance to each other. Each ring 12, 13, 14, 15 is separately producible by means of laser sintering or another 3D print method. Each ring 12, 13, 14, 15 can have a different surface structure and/or perforation.

Figure 3:
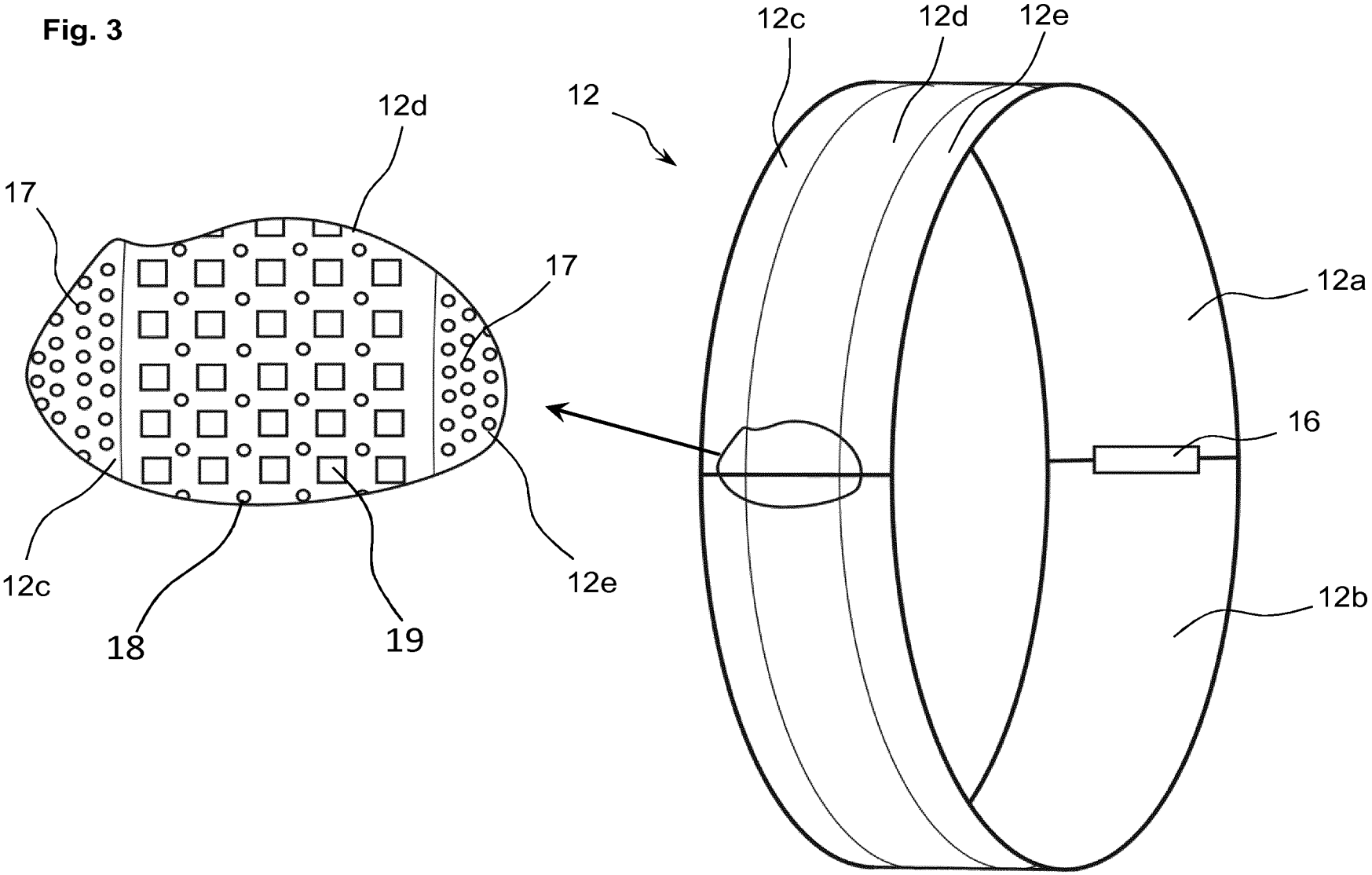
FIG. 3 shows a single ring of a structured shell with enlargement of the surface.

FIG. 3 shows a ring 12 of a structured shell 11, wherein the individual ring 12 consists of two semi-circular segments 12*a*, 12*b*, respectively sectors of a ring, which can be formed as a circular ring and which include attachment elements 16 on the backside. The segments 12*a*, 12*b* can be produced as plane flat bodies, and can be bent and connected according to the diameter of the drum to form respectively one circular ring. In this case, each ring 12 can be formed from one or more segments. Obviously, the ring 12 can be formed in one piece.

The ring 12 includes alternating sections 12*c*, 12*d*, 12*e* with different structuring such that either a continuous uniform pattern is created in the web over the width of the ring 12 or separate or continuous areas with different patterns are producible in the web.

An enlarged area broken out in FIG. 3, as indicated by the arrow, shows an enlarged section of the ring 12 of the structured shell 11 shown in FIGS. 1 and 2, that includes areas having a different structure and perforation. In the middle section 12*d* is disposed a perforation with large holes 18, between protruding elevations 19 having the shape of squares. The squares can have any optional height and size above the base of the ring, and for example may have a height of 15 mm. The elevation 19 in combination with the water jets of the water bar 1 can create a perforation in the web with corresponding design. By contrast, the enlarged broken out area in FIG. 3 shows the lateral sections 12*c*, 12*e* having a small regular hole pattern.

Figure 4:
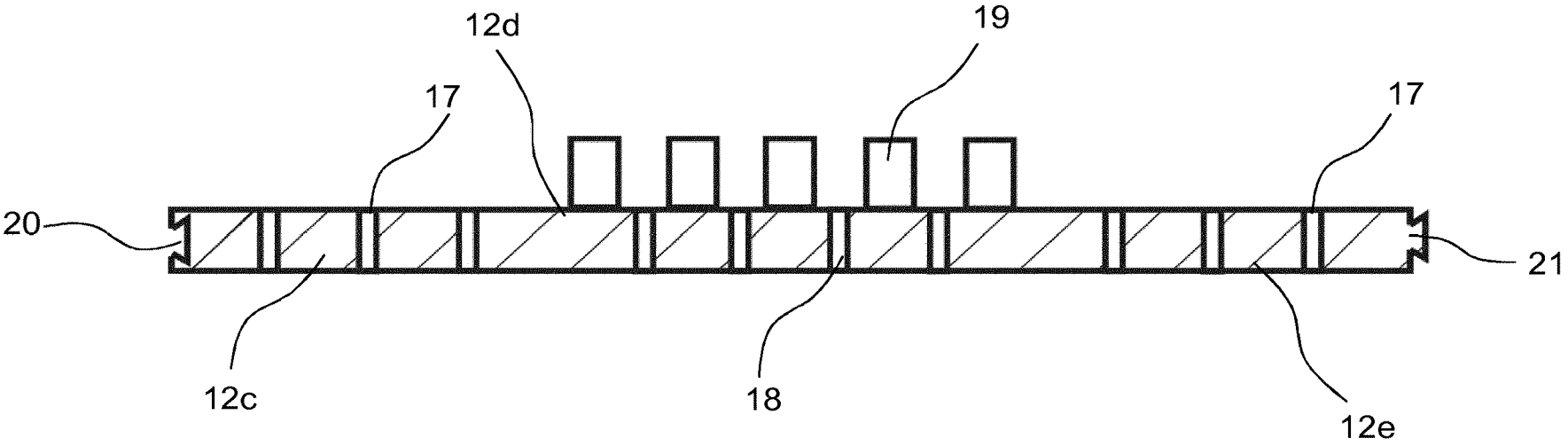
FIG. 4 shows an unwound surface of a single ring of a structured shell according to the invention.

FIG. 4 shows a side view of a cross-section of the ring 12 of a structured drum with the sections 12*c*, 12*d*, 12*e*, in which the neighbouring joints are formed complementarily. A plurality of holes 17, 18 form a hole pattern, which, in the circumferential direction of the section 12*d*, are separated from each other by elevations 19 in the shape of squares. A groove 20 with a tongue 21 in dovetail shape is formed in the area of the upper and lower butt joints and allows for connecting the ends of the segments 12*a*, 12*b* to each other. The partial unwinding can be the template for a circular ring-shaped segment 12*a*, 12*b* of a ring, however, at a corresponding size, it can comprise the circumference of the entire ring.

Figure 5A:
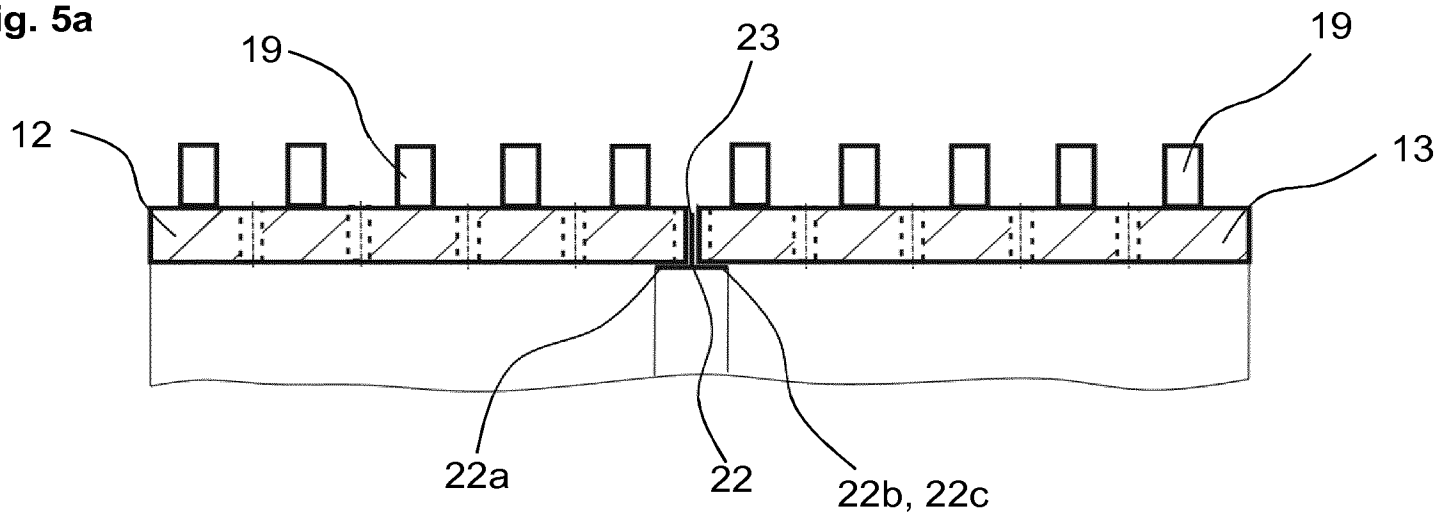
FIGS. 5*a*, 5*b* show two detailed views of a mounted structured shell according to the invention.
Figure 5B:
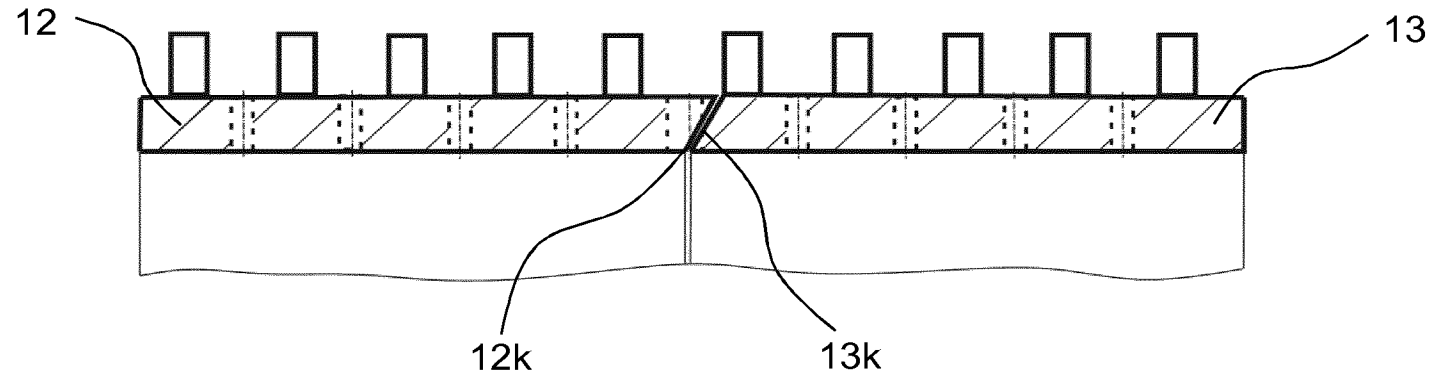

FIGS. 5*a* and 5*b* show different connections of the rings 12, 13 of the structured shell 11 at the butt joints. In FIG. 5*a*, a mounting ring 22 is used, which is disposed under and between the rings 12, 13, and includes a support 22*a*, 22*b* on both sides, on which a portion of the rings is disposed. A spacer 23, which rests at the front edges of the rings 12, 13, can separate the support 22*a*, 22*b*. The support 22*a*, 22*b* can cooperate with a depression of the rings 12, 13, such that the underside of the mounted rings is completely flat. The right support side 22*b* is provided with a rise 22*c*, which engages in a complementary depression of the ring 13 on the underside thereof. The result is a form-fit closure, that is design as a clip connection. In addition, the right support side 22*b* can be provided with an adhesive connection. The left support side 22*a* is flat and can be connected with adhesive to the underside of the ring 12. Both variants of a positive or non-positive connection of the mounting ring 22 to the rings 12, 13 can be used as a releasable or non-releasable connection.

In FIG. 5*b*, the front edges 12*k*, 12*k* of the rings 12, 13 are formed as overlapping oblique areas, which clamping elements 26 connect to each other. Here too, an adhesive connection can be used, in case of waiving the releasable version.

As at least two rings 12, 13 form the structured shell 11, manufacturing methods can be employed which are not readily possible for the entire working width of a drum 10 for hydroentangling. In particular, laser sintering or other 3D print methods allow for complex surface structuring, which are not possible with traditional stamping and/or etching methods. Separately mounting the rings 12, 13, 14, 15 releasably to the drum 10 results in the advantage of easy mounting and flexibly adapting to the width of the web to be treated. The rings 12, 13, 14, 15 with different surfaces can be mounted in optional order and arrangement, which makes manufacturing strip-shaped webs very flexible. In this case, the water bar 1 with an adapted nozzle strip 2 is adaptable to the structured shell 11, wherein, in the area of the abutting edges of the rings, the nozzle strip 2 has interruptions 5, so that no strip-marks form in the web.

Mounting the rings 12, 13, 14, 15 non-releasably to each other before or as assembled on the drum 10, results in an integrally structured shell 11 after the mounting is completed. Based on the manufacturing method, this can have a more varied surface structuring than would be possible with a one-piece structured shell 11. If it is intended to produce a wide web without longitudinal strips having a complex surface structuring and/or perforation, the individual rings 12, 13, 14, 15 can be joined to each other as well and the surface can be electroplated, for example nickel plated such as to be able to manufacture an integral structured shell 11 from individual rings. This shell is advantageous in that complex surface structuring is possible without the manufacturing method producing longitudinal strips in the web. The nozzle strip 2 can be correspondingly adapted and embodied with or without interruptions 5.

The invention claimed is:

1. A device for hydroentangling and/or structuring a web, comprising:

a suctioning rotating drum having a cylindrical surface;

a structured shell disposed on the drum at a distance from the cylindrical surface, the structured shell including at least two separate rings each constructed to be pushed on, independent of one another, and attached to the drum adjacent one another to collectively form the structured shell around which the web can be at least partially looped; and at least one water bar including a nozzle strip with a plurality of nozzles to project water jets, wherein the water bar is arranged relative to the structured shell to entangle and/or to structure and/or to perforate the web when on the structured shell by the water jets.

2. The device according to claim 1, wherein the rings collectively have a width in a longitudinal direction of the drum and the rings have edges that abut one another; and the plurality of nozzles of the water bar extend to the width of the rings and are interrupted in an area of the abutting edges of the rings.

3. The device according to claim 1, and further including distancing elements disposed on the cylindrical surface of the drum to distance the rings from the cylindrical surface of the drum.

4. The device according claim 1, further comprising clamping elements to axially affix the rings on the drum.

5. The device according to claim 1, wherein the rings comprise 3D printed rings or rings made by laser sintering.

6. The device according to claim 1, wherein each ring comprises at least one segment.

7. The device according to claim 1, wherein each ring includes at least two sections each of which has different structuring.

8. The device according to claim 1, wherein the rings have a three-dimensional pattern which rises above a surface of the rings.

9. The device according to claim 1, further including mounting rings arranged to connect the rings together at edges of the rings.

10. The device according to claim 1, wherein the rings have overlapping edges, at which the rings are connectable by material, positively and/or non-positively.

11. The device according to claim 1, wherein each ring comprises two segments.

12. A structured shell for use in a device having a cylindrical suctioning drum for entangling and/or structuring a web by hydroentangling, the structured shell comprising at least two separate structured rings each constructed to be pushed on, independent of one another, and attached to the drum adjacent one another thereby presenting the structured shell, wherein each structured ring includes at least fine porous openings to at least one of entangle and structure the web when water jets are sprayed against the web when the web is at least partially looped around the structured shell.

13. The structured shell according to claim 12, wherein the structured rings comprise 3D printed rings or rings made by laser sintering.

14. The structured shell according to claim 12, wherein each structured ring comprises at least one segment.

15. The structured shell according to claim 12, wherein each structured ring includes at least two sections each of which has different structuring.

16. The structured shell according to claim 12, wherein the structured rings have a three-dimensional pattern which rises above a surface of the rings.

17. The structured shell according to claim 12, further including mounting rings arranged to connect the structured rings together at edges of the rings.

18. The structured shell according to claim 12, wherein the structured rings have overlapping edges, at which the rings are connectable by material, positively and/or non-positively.

19. The structure shell according to claim 12, wherein each structured ring comprises two segments.

* * * * *